US007058333B2

(12) United States Patent
Shin

(10) Patent No.: US 7,058,333 B2
(45) Date of Patent: Jun. 6, 2006

(54) COLOR IMAGE FORMING APPARATUS

(75) Inventor: Kyu-cheol Shin, Gwascheon (KR)

(73) Assignee: Samsung Electronics Co., Ltd., Suwon-Si (KR)

( * ) Notice: Subject to any disclaimer, the term of this patent is extended or adjusted under 35 U.S.C. 154(b) by 122 days.

(21) Appl. No.: 10/706,959

(22) Filed: Nov. 14, 2003

(65) Prior Publication Data

US 2004/0096236 A1 May 20, 2004

(30) Foreign Application Priority Data

Nov. 19, 2002 (KR) ..... 10-2002-0071905

(51) Int. Cl.
*G03G 15/00* (2006.01)

(52) U.S. Cl. ..... 399/88; 399/89

(58) Field of Classification Search ..... 399/88, 399/89, 298–300, 302
See application file for complete search history.

(56) References Cited

U.S. PATENT DOCUMENTS 5,159,357 A * 10/1992 Ng et al. ..... 347/119
6,421,521 B1 * 7/2002 Tanaka ..... 399/299

FOREIGN PATENT DOCUMENTS

JP 2000162880 A * 6/2000
JP 2002148888 A * 5/2002

* cited by examiner

*Primary Examiner*—Arthur T. Grimley
*Assistant Examiner*—Ryan Gleitz
(74) *Attorney, Agent, or Firm*—Staas & Halsey LLP

(57) ABSTRACT

A color image forming apparatus which, in a sequential order for each of plural colors of a composite color image, charges plural photosensitive bodies, exposes electrostatic latent images on the plural photosensitive bodies, develops latent images on the photosensitive bodies into color images, and transfers the color images to sequentially form images of each of the plural colors one on another to form the composite color image and transcribing the composite color image onto a printing medium. The color image forming apparatus includes: plural charging units which perform the charging process for each of the plural colors; plural exposing units which perform the exposing process for each of the plural colors; plural developing units which perform the developing process for each of the plural colors; and plural transfer units which perform the transfer process for each of the plural colors.

14 Claims, 8 Drawing Sheets

COLOR IMAGE FORMING APPARATUS

CROSS-REFERENCE TO RELATED APPLICATIONS

This application claims the benefit of Korean Application No. 2002-71905, filed Nov. 19, 2002, in the Korean Intellectual Property Office, the disclosure of which is incorporated herein by reference.

BACKGROUND OF THE INVENTION

1. Field of the Invention

The present invention relates to a single pass type color image forming apparatus, and more particularly to a color image forming apparatus capable of supplying power to a plurality of developing devices, transfer devices and charging devices with a single power supply device.

2. Description of the Related Art

Generally, for a high speed image formation, a single pass type color image forming apparatus is provided with a plurality of color image forming units which are arranged along the traveling direction of the transfer belt to form a color image. Such a single pass type color image forming apparatus is sometimes called a tandem type color image forming apparatus. The plurality of color image forming units generally represent cyan (C), magenta (M), yellow (Y) and black (K) color images. The color image forming apparatus may be, for example, a color printer or a color photocopier that can reproduce color image on the printing medium.

FIG. 1 shows a conventional single pass type color image forming apparatus.

Referring to FIG. 1, the color image forming apparatus includes a plurality of color image forming units, a transfer belt 50, a paper transfer unit 40 and a plurality of power supply units.

The plurality of color image forming units are arranged along the traveling direction (arrow) of the transfer belt 50 for forming cyan (C), magenta (M), yellow (Y) and black (K) images. The color image forming units respectively includes photosensitive bodies 10C, 10M, 10Y, 10K for transcribing the image onto the transfer belt 50, transfer units 30C, 30M, 30Y, 30K arranged opposite to the photosensitive bodies 10C, 10M, 10Y, 10K with respect to the transfer belt 50 disposed therebetween, and developing units 20C, 20M, 20Y, 20K for developing an electrostatic latent image formed on the photosensitive bodies 10C, 10M, 10Y, 10K with a developer such as toner or ink. On one side of each photosensitive body 10C, 10M, 10Y, 10K is formed charging unit 12C, 12M, 12Y, 12K for charging the surface of the photosensitive body 10C, 10M, 10Y, 10K, and on one side of each developing roller 21C, 21M, 21Y, 21K is formed a feeding roller 22C, 22M, 22Y, 22K for feeding a developer to the developing roller 21C, 21M, 21Y, 21K.

An image of respective colors is formed on the transfer belt 50 by the plurality of color image forming units as the respective color image are sequentially formed on one another, and the complete image is transcribed by the paper transfer apparatus 40.

The paper transfer apparatus 40 transcribes the color image from the transfer belt 50 onto a printing medium 49 fed from a printing medium feeding unit (not sown) and then fixes the image.

A power supply apparatus supplies power to the respective units and includes separate power supply units that supply power to each of the units. Accordingly, provided to the power supply apparatus are: a plurality of first power supply units 24C, 24M, 24Y, 24K, 23C, 23M, 23Y, 23K, 14C, 14M, 14Y, 14K for supplying power to the developing rollers 21C, 21M, 21Y, 21K, feeding rollers 22C, 22M, 22Y, 22K and charging rollers 12C, 12M, 12Y, 12K; second power supply units 32C, 32M, 32Y, 32K for supplying power to the plurality of transfer rollers 30C, 30M, 30Y, 30K; and a third power supply unit 46 for supplying power to the paper transfer apparatus 40. In other words, at least 16 separate power supply units are required. Each of the power supply units supplies a different voltage level suitable for the corresponding process performed by the unit to which it is associated, and the level of the voltage is adjustable with respect to each of the power supply units.

As described above, in a conventional single pass type color image forming apparatus, since separate power supply units are respectively required for each of the rollers and transfer rollers of the color image forming unit, the size of the color image forming apparatus tends to be large and costly to manufacture. As a result, there has been a demand for a simplified color image forming apparatus with a simplified power supply unit, tending to be smaller and less costly to manufacture.

SUMMARY OF THE INVENTION

Accordingly, it is an aspect of the present invention to provide a single pass type color image forming apparatus having a power supply apparatus of simple construction for supplying power to the respective parts, which is compact-sized and manufactured at reduced cost.

Additional aspects and/or advantages of the invention will be set forth in part in the description which follows and, in part, will be obvious from the description, or may be learned by practice of the invention.

According to an aspect of the present invention, there is provided a color image forming apparatus which, in a sequential order for each of plural colors of a composite color image, charges plural photosensitive bodies, exposes electrostatic latent images on the plural photosensitive bodies, develops latent images on the photosensitive bodies into color images, and transfers the color images to sequentially form images of each of the plural colors one on another to form the composite color image and transcribing the composite color image onto a printing medium. The color image forming apparatus includes: plural charging units which perform the charging process for each of the plural colors; plural exposing units which perform the exposing process for each of the plural colors; plural developing units which perform the developing process for each of the plural colors; plural transfer units which perform the transfer process for each of the plural colors; and a power supply unit which supplies power to the plural charging units, the plural developing units, and the plural transfer units.

A charging power supply unit may branch an output from a single charging power transforming unit and may supply the branched power.

A developing power supply unit may supply the power to the plural developing units. The developing power supply unit may include a single developing power transforming unit, and plural developing voltage dropping members disposed between the developing power transforming unit and the respective developing units.

The plural developing units may include feeding rollers that supply a developer, and feeding voltage dropping members may be disposed between the feeding rollers and the plural developing voltage dropping members.

The color image forming apparatus may include a transfer power unit that supplies power to the plural transfer units. The transfer power unit may include a single transfer power transforming unit, and plural transfer voltage dropping members may be disposed between the transfer power transforming unit and the respective transfer units.

The developing voltage dropping members may be zener diodes.

The power transforming unit is a DC—DC converter that controls the output voltage by controlling pulse width.

According to another aspect of the present invention, there is provided a color image forming apparatus which forms a composite color image on a printing medium by transferring and fixing a composite color image from a transfer medium onto the printing medium, including: plural photosensitive bodies arranged on a side of and in contact with the transfer medium in an order, for bearing an image on a surface thereof; plural transfer units each disposed opposite to the side of the transfer medium on which the photosensitive bodies are arranged, for transferring the image from the surface of each of the plural photosensitive bodies onto the transfer medium by pressing the transfer medium into contact with the surfaces of the plural photosensitive bodies; plural charging units each disposed on a side of each of the plural photosensitive bodies, for charging the surface of each of the plural the photosensitive bodies; plural developing units each disposed on a lower side of each of the plural photosensitive bodies, for developing electrostatic latent images formed on the surface of each of the plural the photosensitive bodies; and a power transforming unit for modulating externally-supplied power to a power suitable for the plural transfer units, the plural charging units and the plural developing units, and which controls an output voltage in accordance with an operation environment; and plural voltage dropping members each disposed between the power transforming unit and the plural transfer units and between the power transforming unit and the developing units, for dropping a voltage output from the power transforming unit into a power suitable for the plural transfer units and the plural developing units.

The plural developing units may include developer feeding rollers for feeding the developers, and feeding voltage dropping members may be disposed between the plural developer feeding rollers and the plural voltage dropping members.

According to still another aspect of the present invention, there is provided an image forming device which includes: a plurality of photosensitive bodies, one for each color of a composite color image; a plurality of charging units which charge a surface of each of the plurality of photosensitive bodies so that an electrostatic latent image is formable thereon; a plurality of developing units which develop electrostatic latent images formed on the surfaces of the plurality of photosensitive bodies; a plurality of transfer units which transfer developed electrostatic latent images onto a transfer medium; a charging power supply unit which powers the plurality of charging units; a developing power supply unit which powers the plurality of developing units; and a transfer power supply unit which powers the plurality of transfer units.

According to yet another aspect of the present invention, there is provided an image forming device, including: a plurality of photosensitive bodies, one for each color of a composite color image; a plurality of charging units which charge a surface of each of the plurality of photosensitive bodies so that an electrostatic latent image is formable thereon; a plurality of developing units which develop electrostatic latent images formed on the surfaces of the plurality of photosensitive bodies; a plurality of transfer units which transfer developed electrostatic latent images onto a transfer medium; and a power transforming unit, which powers the plurality of charging units, the plurality of developing units, and the plurality of transfer units.

BRIEF DESCRIPTION OF THE DRAWINGS

These and/or other aspects and advantages of the invention will become apparent and more readily appreciated from the following description of the embodiments taken in conjunction with the accompanying drawings in which.

DETAILED DESCRIPTION OF THE PREFERRED EMBODIMENTS

Figure 1:
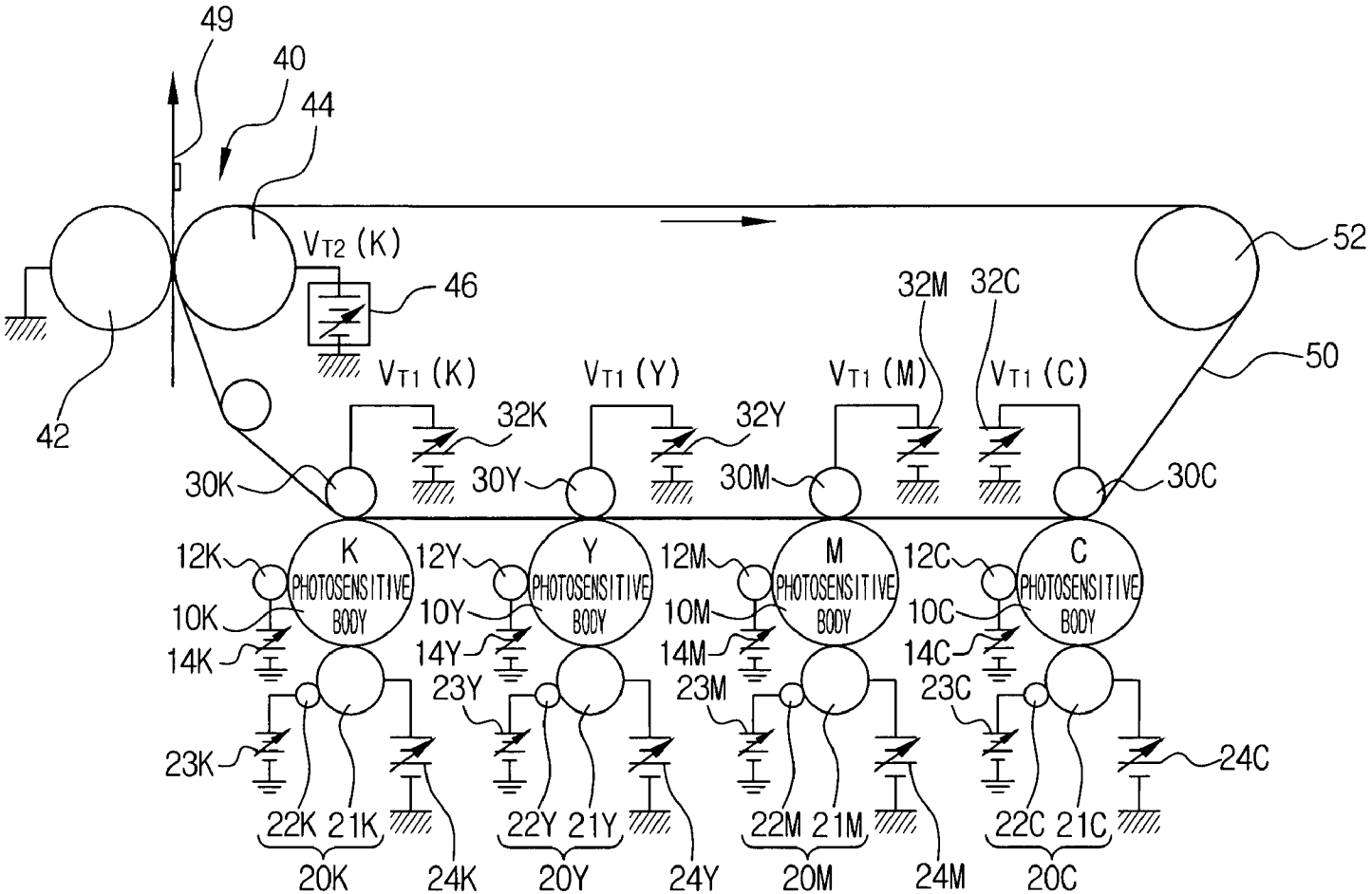
FIG. 1 (PRIOR ART)
FIG. 1 is a schematic view showing the structure of a conventional color image forming apparatus.

Reference will now be made in detail to embodiments of the present invention, examples of which are illustrated in the accompanying drawings, wherein like reference numerals refer to the like elements throughout. The embodiments are described below to explain the present invention by referring to the figures.

Throughout the description, the same parts with the parts of the conventional apparatus shown in FIG. 1 will be referred to by the same reference numerals, and where possible, the redundant description will be omitted.

Figure 2:
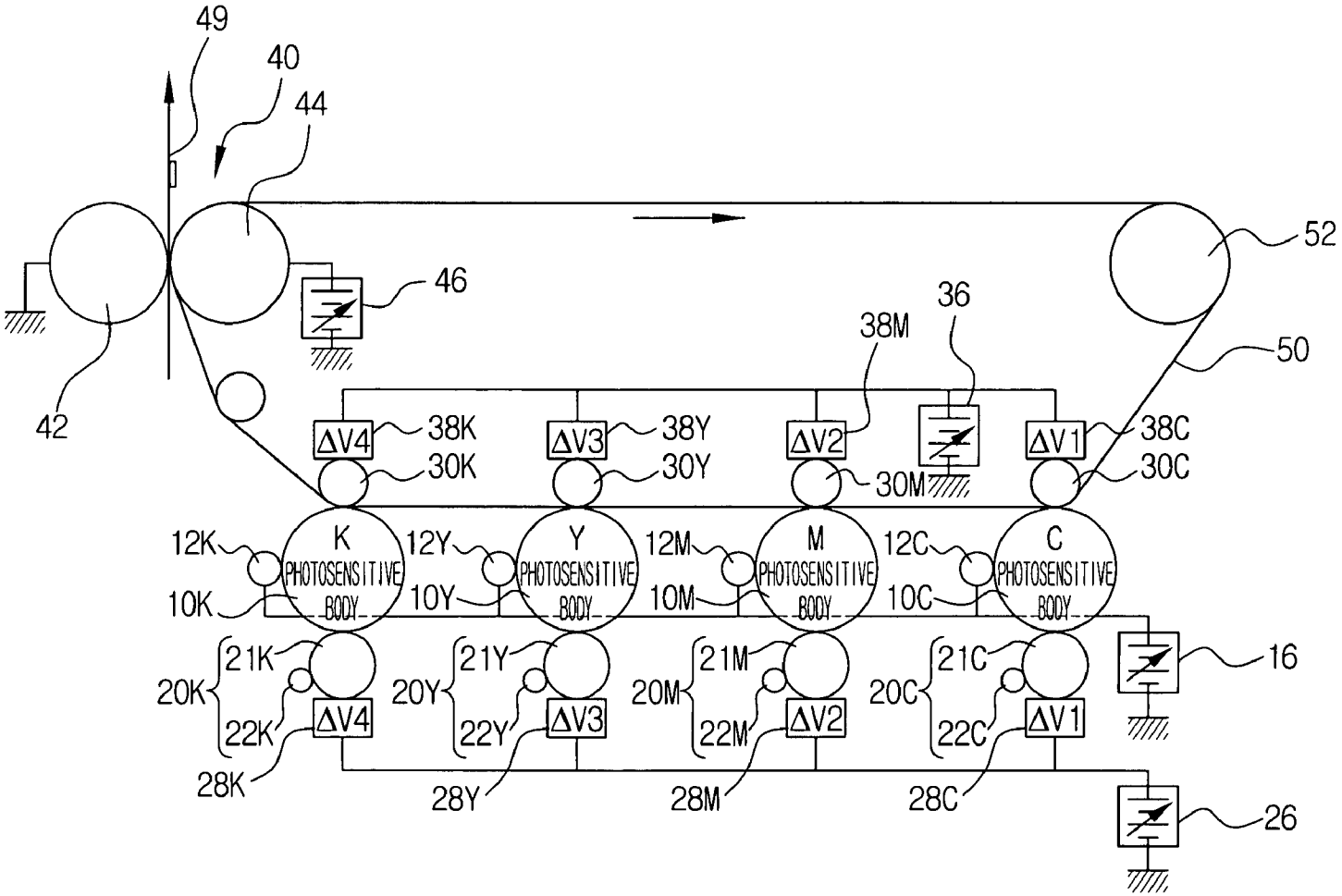
FIG. 2 is a schematic view showing a color image forming apparatus according to a first embodiment of the present invention.
Figure 6:
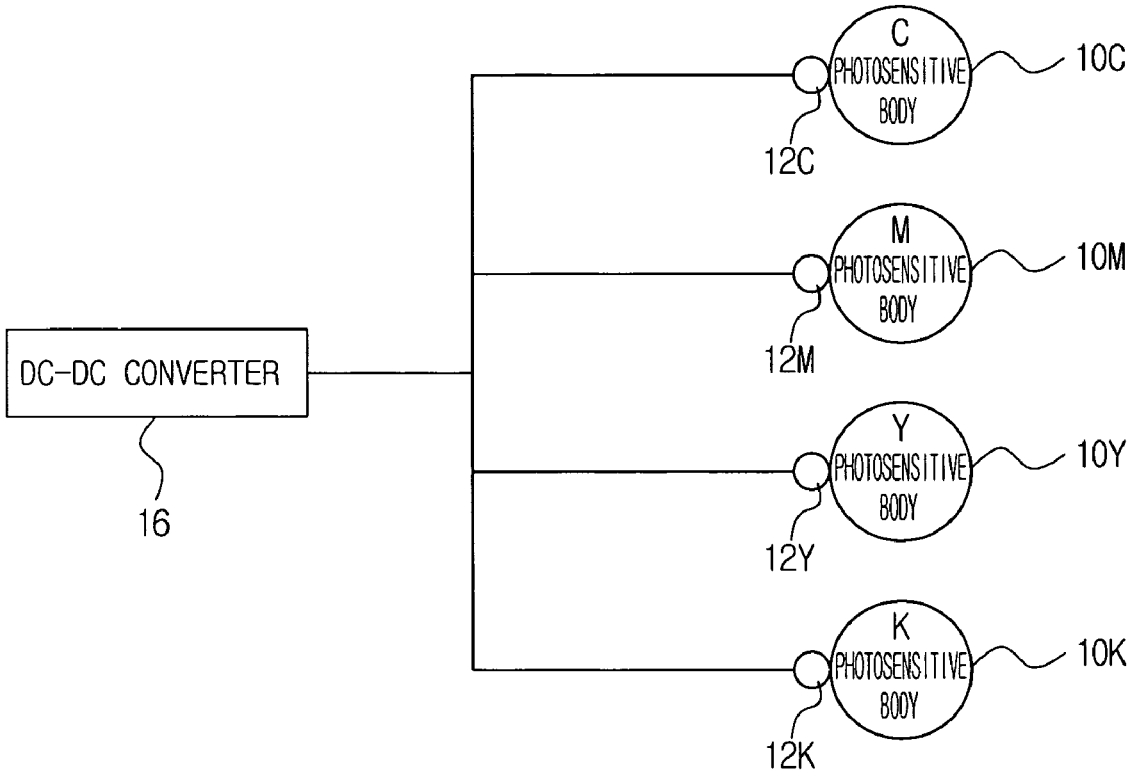
FIG. 6 is a schematic view showing the charging power supply apparatus of the color image forming apparatus of FIG. 2.

Referring to FIGS. 2 and 6, the color image forming apparatus according to a first embodiment of the present invention includes 4 photosensitive bodies 10C, 10M, 10Y, 10K, transfer medium 50, 4 transfer units 30C, 30M, 30Y, 30K, 4 developing units 20C, 20M, 20Y, 20K, 4 charging units 12C, 12M, 12Y, 12K, a paper transfer unit 40, a transfer power transforming unit 36, a developing power transforming unit 26 and a charging power transforming unit 16.

In an image forming operation, the surfaces of each of the photosensitive bodies 10C, 10M, 10Y, 10K is charged by an associated charging units 12C, 12M, 12Y, 12K, and an electrostatic latent image is formed on the photosensitive bodies 10C, 10M, 10Y, 10K by the laser light emitted from an associated exposure unit (not shown). The electrostatic latent images on each of the photosensitive bodies 10C, 10M, 10Y, 10K is developed by the developer fed from associated developing units 20C, 20M, 20Y, 20K, and the developed images are transcribed onto the transfer medium 50 by the transfer units 30C, 30M, 30Y, 30K, respectively. In order to represent color of the image, 4 photosensitive bodies 10C, 10M, 10Y, 10K are provided for developing a color image with 4 colors of developers. In other words, the 4 photosensitive bodies 10C, 10M, 10Y, 10K, each corresponding to the color developers of cyan C, magenta M, yellow Y and black K, are arranged in turn on the transfer medium 50 in the traveling direction (arrow of FIG. 2), and accordingly, respectively colored images are formed on the transfer medium 50 on one another.

After sequentially forming the respective color images of the photosensitive bodies 10C, 10M, 10Y, 10K on one another and thus completing a given image, the complete color image is transferred onto the paper transferring unit 40. The transfer medium 50 is a transfer belt which is driven by a driver roller 52. In this embodiment, the transfer belt 50 is disposed to rotate clockwise (arrow of FIG. 2). However, it is to be understood that the transfer medium may be another medium and may be driven in another direction and by other means.

The transfer units 30C, 30M, 30Y, 30K are formed on the inner side of the transfer medium 50, opposing the photosensitive bodies 10C, 10M, 10Y, 10K, respectively. The transfer units 30C, 30M, 30Y, 30K respectively transcribe the developed image from the surface of each of the photosensitive bodies 10C, 10M, 10Y, 10K onto the transfer medium 50. More specifically, the transfer units 30C, 30M, 30Y, 30K correspond to the 4 photosensitive bodies 10C, 10M, 10Y, 10K, and different levels of power are supplied to the respective transfer units 30C, 30M, 30Y, 30K to transfer the respective developed color images from the surface of the photosensitive bodies 10C, 10M, 10Y, 10K onto the transfer medium 50 one after another (i.e., sequentially). The first transfer unit 30C in the advancing direction of the transfer medium 50 has the least voltage level, and the voltage level increases toward the last transfer unit 30K which the highest level of voltage.

The developing units 20C, 20M, 20Y, 20K are disposed on the lower sides of the photosensitive bodies 10C, 10M, 10Y, 10K, developing electrostatic latent images of the surfaces of the photosensitive bodies 10C, 10M, 10Y, 10K with a proper developer such as toner or ink. The developing units 20C, 20M, 20Y, 20K each include a developing rollers 21C, 21M, 21Y, and 21K disposed to rotate in a direction opposite to that of the photosensitive bodies 10C, 10M, 10Y, 10K, respectively, and a feeding rollers 22C, 22M, 22Y, and 22K, that feed the developer onto the developing rollers 22C, 22M, 22Y, and 22K, respectively. Albeit not shown, the developing units 20C, 20M, 20Y, 20K are connected to a developer container.

The developing units 20C, 20M, 20Y, 20K develop electrostatic latent images of the 4 photosensitive bodies 10C, 10M, 10Y , 10K with C, M, Y and K developers, respectively.

The charging units 12C, 12M, 12Y, 12K are disposed on one side of each of the photosensitive bodies 10C, 10M, 10Y, 10K, respectively, and charge the surface of the photosensitive bodies 10C 10M, 10Y, 10K with a level of electricity so that an electrostatic latent image is formable on the surface of each of the photosensitive bodies 10C, 10M, 10Y, 10K by an exposure unit (not shown).

The paper transfer unit 40 transfers the color image from the transfer medium 50 onto the printing medium 49 fed from the printing medium feeding unit (not shown) for fusing, and includes a paper transfer roller 42 and a paper transfer backup roller 44. The paper transfer unit 40 is supplied with the electricity from a power supply unit 46.

The transfer power transforming unit 36 and a plurality of transfer voltage dropping members 38C, 38M, 38Y, 38K cooperate to supply appropriate power to the transfer units 30C, 30M, 30Y, 30K.

The transfer power transforming unit 36 transforms externally-supplied DC, or AC power into a DC power that is suitable to operate the transfer units 30C, 30M, 30Y, 30K. AC-DC conversion is used as the transfer power transforming unit 36 when the external power is AC, while DC—DC conversion is used when the external power is DC.

Figure 4:
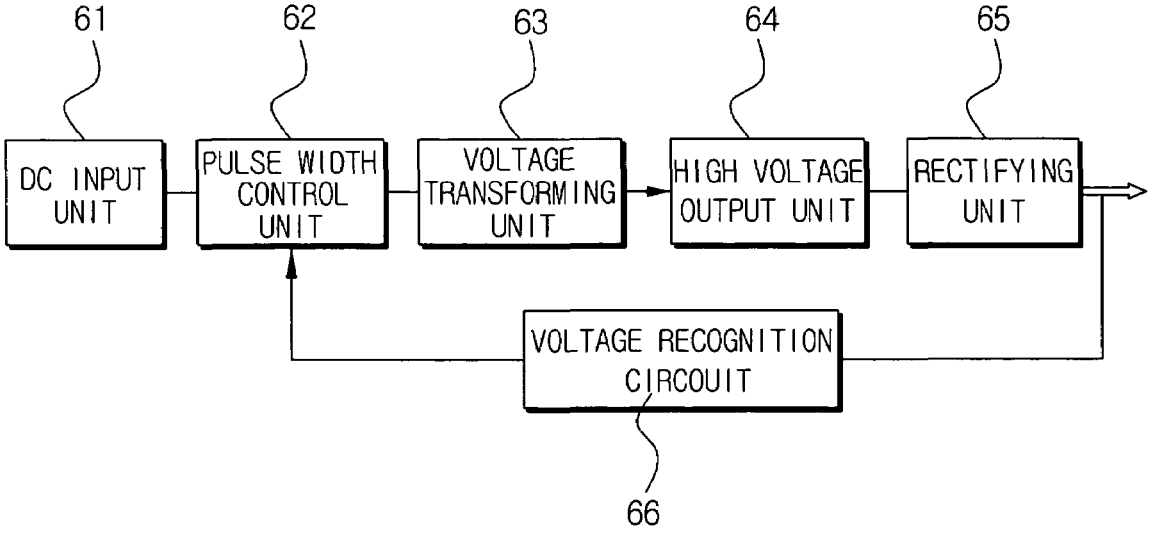
FIG. 4 is a block diagram showing the power transforming apparatus of the transfer power supply apparatus of FIGS. 3A and 3B.

FIG. 4 illustrates one example of the DC—DC converter employed in this embodiment. Referring to FIG. 4, a DC—DC converter includes a pulse width control unit 62, a voltage transforming unit 63, a high voltage output unit 64, a rectifying unit 65 and a voltage recognition circuit 66. DC power, being input to the DC input unit 61, is converted into high DC voltage as it passes through the pulse width control unit 62, the power transforming unit 63, the high voltage output unit 64, and the converted voltage is fed to the transfer unit 30 to the rectifying unit 65. The level of output DC voltage is detected at the voltage recognition circuit 66 and returned to the pulse width control unit 62, and the pulse width control unit 62 being informed of the detected voltage level modulates the pulse width so that appropriate output can be obtained.

Figure 3A:
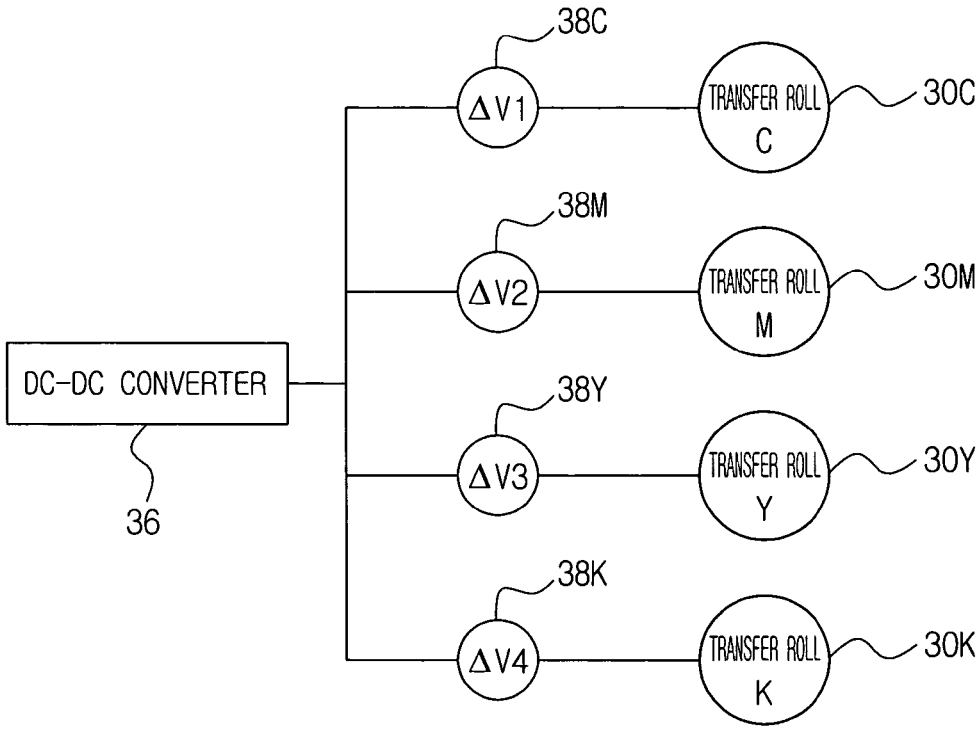
FIGS. 3A and 3B are schematic views showing the transfer power supply apparatus of the color image forming apparatus of FIG. 2 according to an embodiment of the present invention.
Figure 3B:
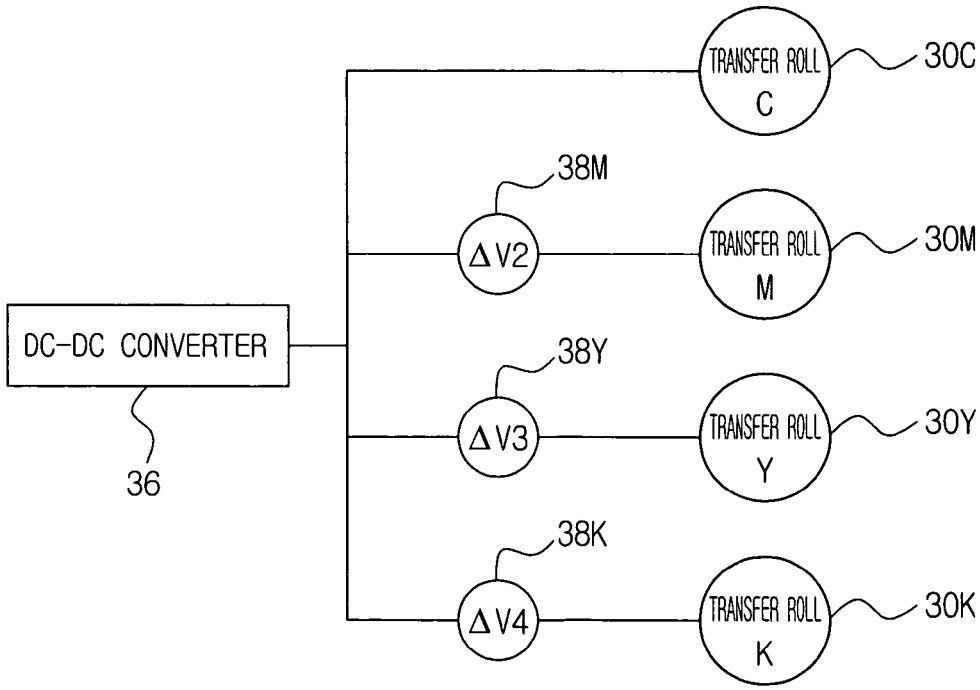
Figure 8A:
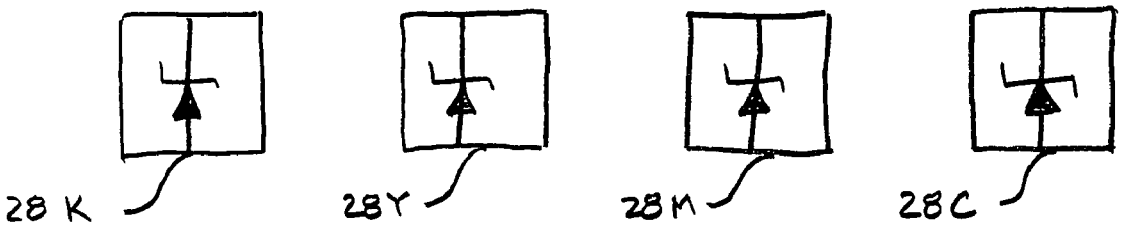
FIGS. 8A and 8B are schematic views showing exemplary configurations of developing voltage dropping units.
Figure 8B:
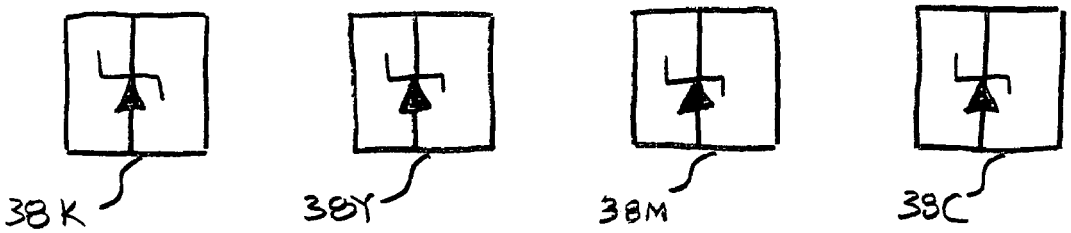

Turning now to FIG. 3*a*, power from the transfer power transforming unit 36 is branched to connect to the transfer units 30C, 30M, 30Y, 30K. Between the transfer power transforming unit 36 and the respective transfer units 30C, 30M, 3Y, 30K are the transfer voltage dropping members 38C, 38M, 38Y, 38K. The transfer voltage dropping members 38C, 38M, 38Y, 38K are electrical elements that adjust the input voltage to the respective transfer units 30C, 30M, 30Y, 30K to render the voltage suitable for the transfer units 30C, 30M, 30Y, 30K. The transfer voltage dropping memebers may be, by way of non-limiting example, a zener diode as shown in FIG. 8B. Since voltage is applied to the 4 transfer units 30C, 30M, 30Y, 30K in different levels, 4 transfer voltage dropping members 38C, 38M, 38Y, 38K, i.e., one transfer voltage dropping member for each transfer unit, are employed. Alternatively, as shown in FIG. 3B, 3 transfer voltage dropping members may be used instead of 4, by fixing the power level from the transfer power transforming unit 36 to the transfer unit 30C where the highest voltage is applied, and then gradually dropping the voltage level to the remaining transfer units 30M, 30Y, 30K from the fixed level by predetermined intervals.

The developing power transforming unit 26 and a plurality of developing voltage dropping members 28C, 28M, 28Y, 28K cooperate to supply appropriate power to the developing rollers 21C, 21M, 21Y, 21K.

The developing power transforming unit 26 converts externally-supplied DC or AC power to a DC power suitable to operate the developing unit, and may be constructed in the same manner as that of the transfer power transforming unit 36, but with the different level of DC voltage from the transfer power transforming unit 36.

A power output from the developing power transforming unit 26 is branched to connect to the 4 developing rollers 21C, 21M, 21Y, 21K (FIG. 5A), and between the developing power transforming unit 26 and the respective developing rollers 21C, 21M, 21Y, 21K are formed the developing voltage dropping members 28C, 28M, 28Y, 28K. The developing voltage dropping members 28C, 28M, 28Y, 28K are electrical elements that adjust the input voltage from the developing power transforming unit 26 to the developing rollers 21C, 21M, 21Y, 21K to a suitable voltage level for the respective developing rollers 21C, 21M, 21Y, 21K. The developing voltage dropping members may be, by way of non-limiting example, zener diodes as show in FIG. 8A. Since voltage is applied to the 4 developing rollers 21C, 21M, 21Y, 21K in different levels, 4 developing voltage dropping members 28C, 28M, 28Y, 28K, i.e., one developing voltage dropping member for one developing unit, are employed. Alternatively, as shown in FIG. 5B, 3 developing voltage dropping members may be used instead of 4, by fixing the power level from the developing power transforming unit 26 to the developing roller 21C where the highest voltage is applied, and then gradually dropping the voltage level to the remaining developing rollers 21M, 21Y, 21K from the fixed level by desired intervals.

On one side of each developing roller 21C, 21M, 21Y, 21K is formed a feeding roller 22C, 22M, 22Y, 22K, respectively, and the power branch from the developing voltage dropping member 28C, 28M, 28Y, 28K is respectively applied to the feeding roller 22C, 22M, 22Y, 22K. Between the respective feeding rollers 22C, 22M, 22Y, 22K and the developing voltage dropping members 28C, 28M, 28Y, 28K are formed the feeding voltage dropping members 29C, 29M, 29Y, 29K respectively, for dropping the voltage output from the developing voltage dropping members 28C, 28M, 28Y, 28K to desired levels. Since same level of voltage is supplied between the developing rollers 21C, 21M, 21Y, 21K and the feeding rollers 22C, 22M, 22Y, 22K, the same parts of same specification may be used for the feeding voltage dropping members 29C, 29M, 29Y, 29K.

Referring to FIG. 6, a power output from the charging power transforming unit 16 is branched to the 4 charging units 12C, 12M, 12Y, 12K. Since the charging units 12C, 12M, 12Y, 12K each require substantially similar level of voltage to charge the photosensitive bodies 10C, 10M, 10Y, 10K, the same level of voltage is applied to the respective charging units 12C, 12M, 12Y, 12K. Accordingly, unlike the transfer power supply unit or the developing power supply unit, the charging power supply unit does not require a voltage dropping member. However, if voltage is applied to the charging units in different levels, the voltage dropping members may be provided to the charging power supply unit.

Figure 7:
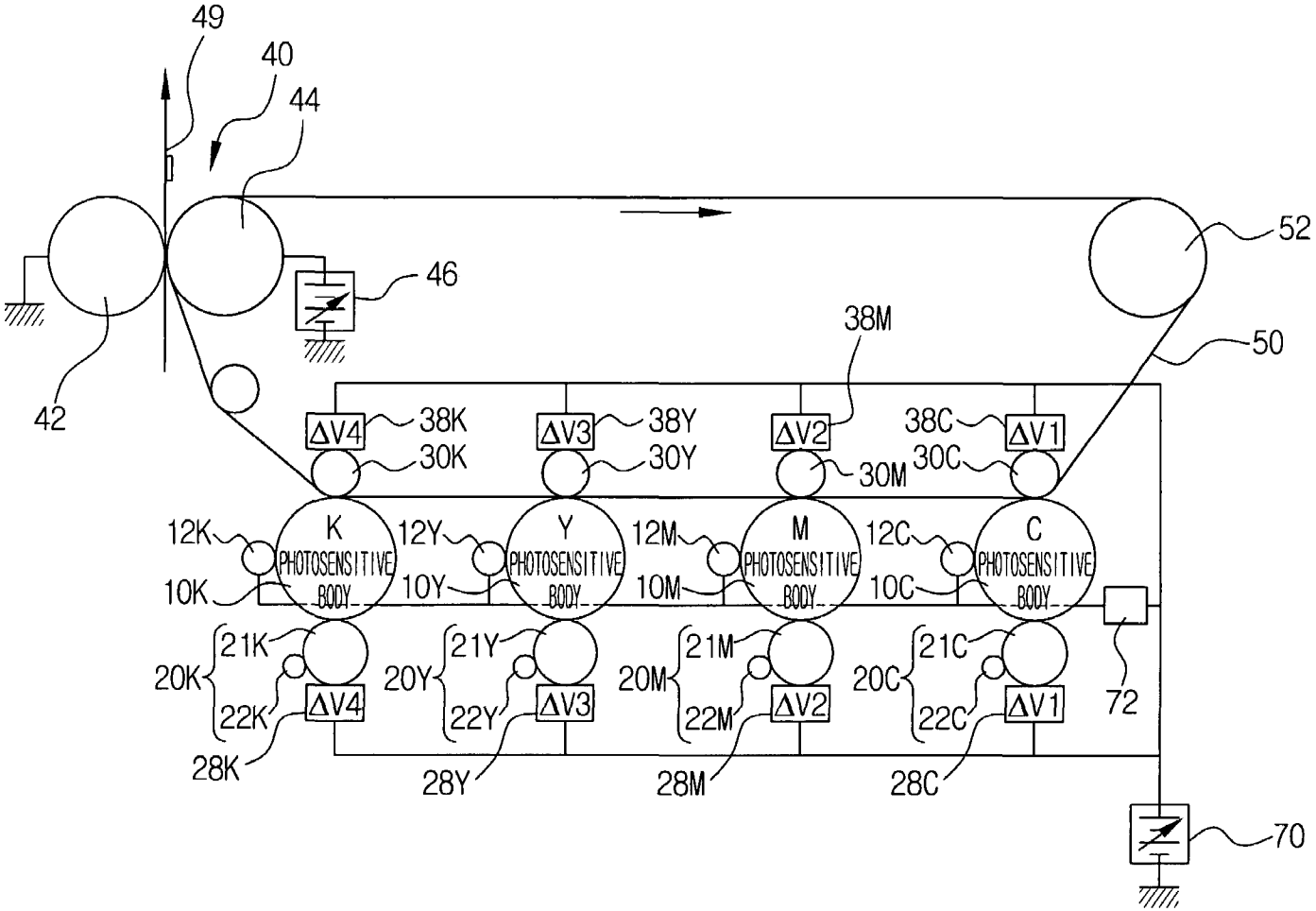
FIG. 7 is a schematic view showing the color image forming apparatus according to a second embodiment of the present.

According to the second embodiment of the present invention, as shown in FIG. 7, necessary power is supplied to the 4 transfer units 30C, 30M, 30Y, 30K, 4 developing units 20C, 20M, 20Y, 20K, and 4 charging units 12C, 12M, 12Y, 12K by using a single power transforming unit 70. The level of voltage to the respective units is adjusted by the voltage dropping members 38C, 38M, 38Y, 38K, 28C, 28M, 28Y, 28K, and 72 which are installed upstream of the respective units. Because the power transforming unit 70 and the voltage dropping members 38C, 38M, 38Y, 38K, 28C, 28M, 28Y, 28K, and 72 are identical to the transfer power transforming unit and the transfer voltage dropping member described above, detailed description thereof will be omitted.

The power supply process to the respective units of the color image forming apparatus constructed as above according to the first embodiment present invention will be described.

First, power supply to the 4 developing units will be described.

Figure 5A:
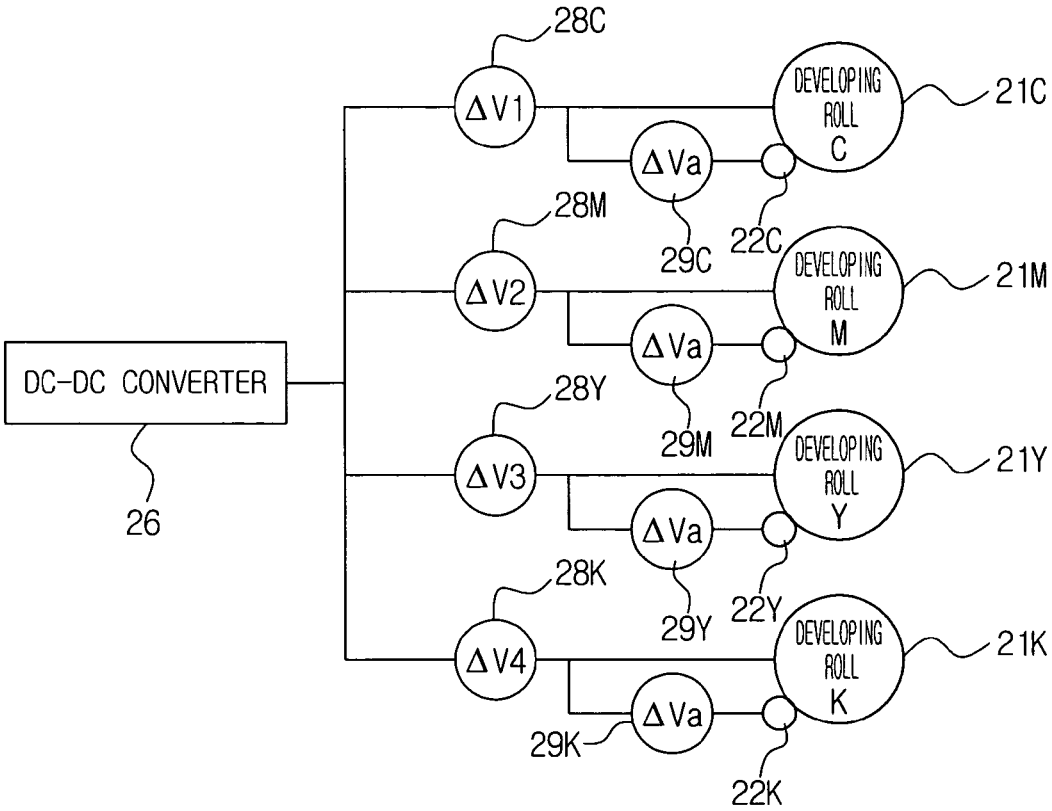
FIGS. 5A and 5B are schematic views respectively showing the developing power supply apparatus of the color image forming apparatus of FIG. 2 according to an embodiment of the present invention.
Figure 5B:
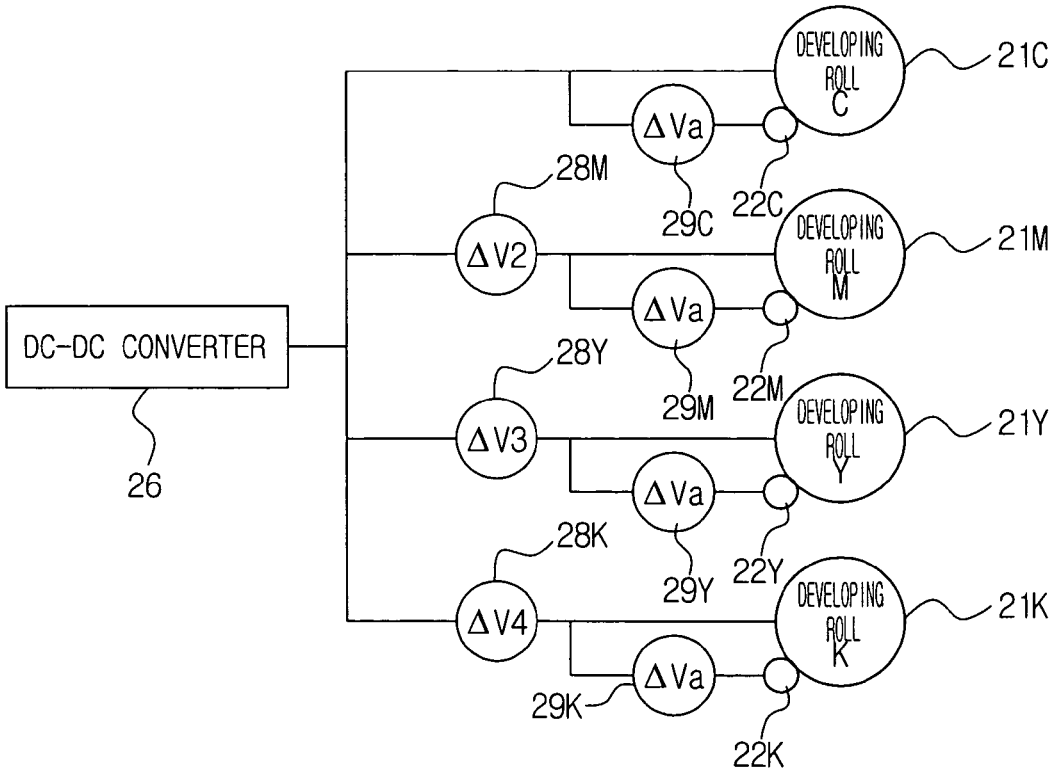

As shown in FIG. 5A, the output from a single developing power transforming unit 26 is branched four ways to connect to the 4 developing voltage dropping members 28C, 28M, 28Y, 28K and then to the developing rollers 21C, 21M, 21Y, 21K. Accordingly, the power outputted from the developing power transforming unit 26 is dropped at the developing voltage dropping members 28C, 28M, 28Y, 28K and applied to the developing rollers 21C, 21M, 21Y, 21K in the reduced levels, respectively. Also, the feeding rollers 22C, 22M, 22Y, 22K, which feed developer to the developing rollers 21C, 21M, 21Y, 21K, are supplied with the power which is branched from the power flowing through the developing voltage dropping members 28C, 28M, 28Y, 28K to the developing rollers 21C, 21M, 21Y, 21K and passed through the feeding power dropping members 29C, 29M, 29Y, 29K. Accordingly, output power from the developing power transforming unit 26 is applied to the developing rollers 21C, 21M, 21Y, 21K in different levels after being respectively reduced by the feeding power dropping members 29C, 29M, 29Y, 29K.

The relation of the developing power transforming unit 26 and the developing voltage dropping members 28C, 28M, 28Y, 28K will be described.

Due to different charge to mass ratios (Charge/Mass) of the cyan, magenta, yellow and black color developers, voltage is also required to be supplied in different levels for the developing of the color developers. In other words, developing voltage varies depending on the respective colors. The respective voltage levels for the respective color developers are maintained at a desired level under a general environment. However, with variation in the environment, the developing voltage also needs to vary. More specifically, the reference of the developing voltage varies in accordance with the changes in the environment, while the gaps between the respective developing voltage levels are maintained constant. In order to satisfy these requirements, the reference of the developing voltage is varied by varying the developing power transforming unit 26, while appropriately adjusting the gaps of voltage levels of the respective color developers with the developing voltage dropping members 28C, 28M, 28Y, 28K. Describing it more detail, with the reference Vd of the developing voltage, and the gaps $\Delta V1$, $\Delta V2$, $\Delta V3$, $\Delta V4$ of voltage levels of the respective color developers, voltages applied to the cyan, magenta, yellow and black developing rollers 21C, 21M, 21Y, 21K are, respectively, $Vd+\Delta V1$, $Vd+\Delta V2$, $Vd+\Delta V3$, $Vd+\Delta V4$. Reference Vd is adjusted by the developing power transforming unit 26, and voltage gaps $\Delta V1$, $\Delta V2$, $\Delta V3$, $\Delta V4$ are maintained by the developing voltage dropping members 28C, 28M, 28Y, 28K.

The voltage, which is applied to the feeding rollers 22C, 22M, 22Y, 22K, is from the developing rollers 21C, 21M, 21Y, 21K via the feeding voltage dropping members 29C, 29M, 29Y, 29K, and accordingly the supplied voltage corresponds to the voltage of the developing rollers 21C, 21M, 21Y, 21K, which has dropped at the feeding voltage dropping members 29C, 29M, 29Y, 29K. Since the 4 feeding voltage dropping members 29C, 29M, 29Y, 29K are same in size, the gaps of the voltage supplied to the feeding rollers 22C, 22M, 22Y, 22K are maintained same as in the developing rollers 21C, 21M, 21Y, 21K of the 4 developing units.

Next, power supply to the 4 transfer units 30C, 30M, 30Y, 30K will be described.

As shown in FIG. 3A, an output power from the transfer power transforming unit 36 is branched four ways to connect to the 4 transfer units 30C, 30M, 30Y, 30K via the transfer voltage dropping members 38C, 38M, 38Y, 38K, respectively. The 4 transfer units 30C, 30M, 30Y, 30K transfer developed cyan, magenta, yellow and black images from the photosensitive bodies 10C, 10M, 10Y, 10K onto the transfer belt 50, and the 4 transfer units 30C, 30M, 30Y, 30K include a transfer roller. With the developer coated on the transfer belt 50, voltage level increases accordingly. Or by the transfer electric field, the transfer belt 50 is charged to some extent. Accordingly, the level of the voltage for transferring the respective color developers from the photosensitive bodies 10C, 10M, 10Y, 10K varies. The levels of transferring voltage are maintained relatively constant, while the reference thereof varies with changes of environment. Also, the reference transfer voltage is adjusted by the transfer power transforming unit 36, while the transfer voltage of the respective colors is adjusted by the transfer voltage dropping members 38C, 38M, 38Y, 38K.

An output power from the single charging power transforming unit 16 is branched four ways to connect to the 4 charging units 12C, 12M, 12Y, 12K. Although the 4 photosensitive bodies 10C, 10M, 10Y, 10K vary in thickness in their layers, the voltage required for the charging of surface is not necessary different. Accordingly, voltage is applied to the charging units 12C, 12M, 12Y, 12K in the same level for charging the 4 photosensitive bodies 10C, 10M, 10Y, 10K. However, since the charging voltage for charging the surface of the photosensitive bodies 10C, 10M, 10Y, 10K varies with the changes in the environment, the charging voltage is adjusted by using the charging power transforming unit 16.

According to the second embodiment of the present invention, since power is supplied to the entire color image forming apparatus from a single power transforming unit 70, the voltage for overall operation is adjusted by the power transforming unit 70, while the specific voltages to the developing units 20C, 20M, 20Y, 20K, the transfer units 30C, 30M, 30Y, 30K and the charging units 12C, 12M, 12Y, 12K are adjusted by using the respective voltage dropping members 28C, 28M, 28Y, 28K, 38C, 38M, 38Y, 38K, and 72. Accordingly, voltage of suitable levels are supplied to the respective units even with the single power transforming unit 70.

As described above, in the color image forming apparatus according to second embodiments of the present invention power required for the plural transfer units, developing units and charging units is supplied respectively through a single transfer power supply unit, a single developing power supply unit and a single charging power supply unit, or, the power required for overall operation of the image forming apparatus is supplied through a single power supply unit. As a result, the number of parts related to power supply is reduced, and the manufacturing cost can be reduced.

Although a few preferred embodiments of the present invention have been shown and described, the present invention is not limited to the disclosed embodiments. Rather, it would be appreciated by those skilled in the art that changes may be made in this embodiment without departing from the principles and spirit of the invention, the scope of which is defined by the claims and their equivalents.

What is claimed is:

1. An image forming device, comprising:

a plurality of photosensitive bodies, one for each color of a composite color image;

a plurality of charging units which charge a surface of each of the plurality of photosensitive bodies so that an electrostatic latent image is formable thereon;

a plurality of developing units which develop electrostatic latent images formed on the surfaces of the plurality of photosensitive bodies;

a plurality of transfer units which transfer developed electrostatic latent images onto a transfer medium;

a charging power supply unit which powers the plurality of charging units;

a developing power supply unit which powers the plurality of developing units;

a transfer supply unit which powers the plurality of transfer units; and a plurality of developing voltage dropping units each of which is disposed between the developing power supply unit and the respective ones of the plurality of developing units and which drop a voltage of a developing power supplied by the developing power supply unit to the plurality of developing units to yield respective developing voltage level gaps in the developing power supplied to each of the plurality of developing units, wherein the plurality of developing voltage dropping units are zener diodes.

2. The image forming device of claim 1, further comprising a plurality of transfer voltage dropping units each of which is disposed between the transfer power supply unit and respective ones of the plurality of transfer units and which drop a voltage of a transferring power supplied by the transfer power supply unit to each of the plurality of transferring units to yield respective transferring voltage level gaps in the transferring power supplied to each of the plurality of transfer units.

3. The image forming device of claim 2, wherein the plurality of transfer voltage dropping units are zener diodes.

4. The image forming device of claim 1, further comprising a plurality of transfer voltage dropping units each of which is disposed between the transfer power supply unit and a transfer unit and which drop a voltage of a transferring power supplied by the transfer power supply, wherein the plurality of transfer units include an upstream transfer unit and downstream transfer units, and wherein the plurality of transfer voltage dropping units are respectively disposed between the transfer power supply unit and the transfer units and which drop the voltages of the power supplied to each of the downstream transfer units to yield respective transferring voltage level gaps in the transferring power supplied to each of the plurality of transfer units.

5. The image forming device of claim 4, wherein the plurality of transfer voltage dropping units are zener diodes.

6. The image forming device of claim 1, wherein each of the plurality of developing units uses a color developer having a different charge to mass ratio and the developing voltage delivered to each of the plurality of developing units differs depending on the color developer used by the respective developing units.

7. The image forming device of claim 1, wherein each of the plurality of developing units includes a developing roller and a feeding roller which feeds developer onto a surface of the developing roller.

8. The image forming device of claim 7, wherein each of the feeding rollers are respectively powered by the voltages output by the plurality of developing voltage dropping units.

9. The image forming device of claim 1, wherein each of the plurality of developing units uses a color developer having a different charge to mass ratio and the developing voltage delivered to each of the plurality of developing units differs depending on the color developer used by the respective developing units.

10. The image forming device of claim 1, wherein each of the plurality of developing units includes a developing roller and a feeding roller which feeds developer onto a surface of the developing roller.

11. An image forming device, comprising:

a plurality of photosensitive bodies, one for each color of a composite color image;

a plurality of charging units which charge a surface of each of the plurality of photosensitive bodies so that an electrostatic latent image is formable thereon;

a plurality of developing units which develop electrostatic latent images formed on the surfaces of the plurality of photosensitive bodies;

a plurality of transfer units which transfer developed electrostatic latent images onto a transfer medium;

a charging power supply unit which powers the plurality of charging units;

a developing power supply unit which powers the plurality of developing units;

a transfer power supply unit which powers the plurality of transfer units;

a plurality of developing voltage dropping units each of which is disposed between the developing power supply unit and the respective ones of the plurality of developing units and which drop a voltage of a developing power supplied by the developing power supply unit to the plurality of developing units to yield respective developing voltage level gaps in the developing power supplied to each of the plurality of developing units; and a plurality of feeding voltage dropping members each of which is disposed between each of the respective ones of the plurality of developing voltage dropping units and a feeding roller and which drop a voltage supplied to each feeding roller to yield respective feeding voltage level gaps in the feeding power supplied to each of the feeding rollers, wherein each of the plurality of developing units includes a developing roller and a feeding roller which feeds developer onto a surface of the developing roller, and wherein each of the feeding rollers are respectively powered by the voltages output by the plurality of developing voltage dropping units.

12. The image forming device of claim 11, wherein the developing power supply unit is a developing power supply transforming unit, and wherein the developing voltage is variable by the developing power transforming unit and when the developing voltage is varied the developing voltage gaps are maintained.

13. An image forming device, comprising:

a plurality of photosensitive bodies, one for each color of a composite color image;

a plurality of charging units which charge a surface of each of the plurality of photosensitive bodies so that an electrostatic latent image is formable thereon;

a plurality of developing units which develop electrostatic latent images formed on the surfaces of the plurality of photosensitive bodies;

a plurality of transfer units which transfer developed electrostatic latent images onto a transfer medium;

a charging power supply unit which powers the plurality of charging units;

a developing power supply unit which powers the plurality of developing units;

a transfer power supply unit which powers the plurality of transfer units;

a plurality of developing voltage dropping units each of which is disposed between the developing power supply unit and respective ones of the plurality of developing units and which drop a voltage of a developing power supplied by the developing power supply, wherein the plurality of developing units includes an upstream developing unit and downstream developing units and the plurality of developing voltage dropping units respectively drop the voltages of the power supplied to each of the downstream transfer units to yield respective developing voltage level gaps in the developing power supplied to each of the plurality of developing units; and a plurality of feeding voltage dropping members each of which is disposed between each of the respective ones of the plurality of developing voltage dropping units and a feeding roller and which drop a voltage supplied to the associated feeding roller to yield respective feeding voltage level gaps in the feeding power supplied to each of the feeding rollers, wherein each of the plurality of developing units includes a developing roller and a feeding roller which feeds developer onto a surface of the developing roller.

14. The image forming device of claim 13, wherein the developing power supply unit is a developing power transforming unit, and wherein the developing voltage is variable by the developing power transforming unit and when the developing voltage is varied the developing voltage gaps are maintained.

* * * * *

UNITED STATES PATENT AND TRADEMARK OFFICE

CERTIFICATE OF CORRECTION

PATENT NO. : 7,058,333 B2
APPLICATION NO. : 10/706959
DATED : June 6, 2006
INVENTOR(S) : Kyu-Cheol Shin It is certified that error appears in the above-identified patent and that said Letters Patent is hereby corrected as shown below:

Title Page (75) Column 1 (Inventor), Line 1, change “Gwascheon” to --Gwacheon--.

Column 10, Line 5, after “transfer” insert --power--.

Column 11, Line 41, after “is a developing power” delete “supply”.

Signed and Sealed this

Twenty-eighth Day of November, 2006

JON W. DUDAS
*Director of the United States Patent and Trademark Office*